United States Patent [19]

Schmid

[11] 3,970,259

[45] July 20, 1976

[54] DEVICE FOR APPLYING ADHESIVE TAPE TO A WIRE COIL

[75] Inventor: Hans Schmid, Ruschlikon, Switzerland

[73] Assignee: Meteor AG, Ruschlikon, Switzerland

[22] Filed: Apr. 16, 1975

[21] Appl. No.: 568,658

[30] Foreign Application Priority Data

Apr. 23, 1974 Switzerland ..... 5531/74

[52] U.S. Cl. ..... 242/7.08; 242/56 R

[51] Int. Cl.[2] ..... H01F 11/04

[58] Field of Search ..... 242/7.08, 7.06, 7.07, 242/7.23, 56 R; 57/3

[56] References Cited

UNITED STATES PATENTS

| | | | |
|---|---|---|---|
| 1,132,765 | 3/1915 | Deafs | 242/56 R |
| 2,927,415 | 3/1960 | Smith | 242/7.08 X |
| 3,117,048 | 1/1964 | Rechel | 242/7.08 X |
| 3,253,794 | 5/1966 | Twigg | 242/56 R X |
| 3,321,352 | 5/1967 | Sejda | 242/7.08 X |

*Primary Examiner*—Edward J. McCarthy
*Attorney, Agent, or Firm*—Cushman, Darby & Cushman

[57] ABSTRACT

A device for applying adhesive tape to wire coils comprising a support pivotable between an operative and inoperative position and carrying a pressure pad for urging tape against a wire coil. A slide on the support is movable towards and away from the pressure pad and carries a roller for pulling tape towards the pressure pad when the slide moves in that direction. A cutter is movable between the slide and the pressure pad for cutting the tape.

8 Claims, 3 Drawing Figures

DEVICE FOR APPLYING ADHESIVE TAPE TO A WIRE COIL

BACKGROUND OF THE INVENTION

1. Field of the Invention

The present invention relates to a device for applying adhesive tape to a wire coil.

2. Description of the Prior Art

In the production of wire coils it is known to secure wire windings, for example on the coil body, by means of a layer of adhesive tape.

SUMMARY

The present invention comprises a device for applying adhesive tape to a wire coil comprising a support movable between an inoperative and an operative position; a pressure member on the support for urging adhesive tape against a wire coil in the operative position of the support; a slide slidable on the support between two limiting positions in a direction transverse to the direction of movement of the support; means on the slide for pulling adhesive tape towards the pressure member when said slide moves into one of said limiting positions; and cutting means movable on a path which extends transversely of the direction of movement of the slide between one of said limiting positions and said pressure member.

Preferably, said support is pivotably movable.

A device of this kind is particularly suitable for use in an automatic coil winding machine in which wire coils, each of which is disposed on a winding mandrel, are guided either on a circular path or on a linear path alongside the device which forms one operating station of the automatic machine. The pivotable arrangement of the support enables the pressure member to be removed from the path of motion of the wire coils which are supported by the winding mandrels so that the wire coils can move unhindered into the operating position of the device and move out of the operating position to the next operating station.

DESCRIPTION OF THE PREFERRED EMBODIMENT

Figure 2:
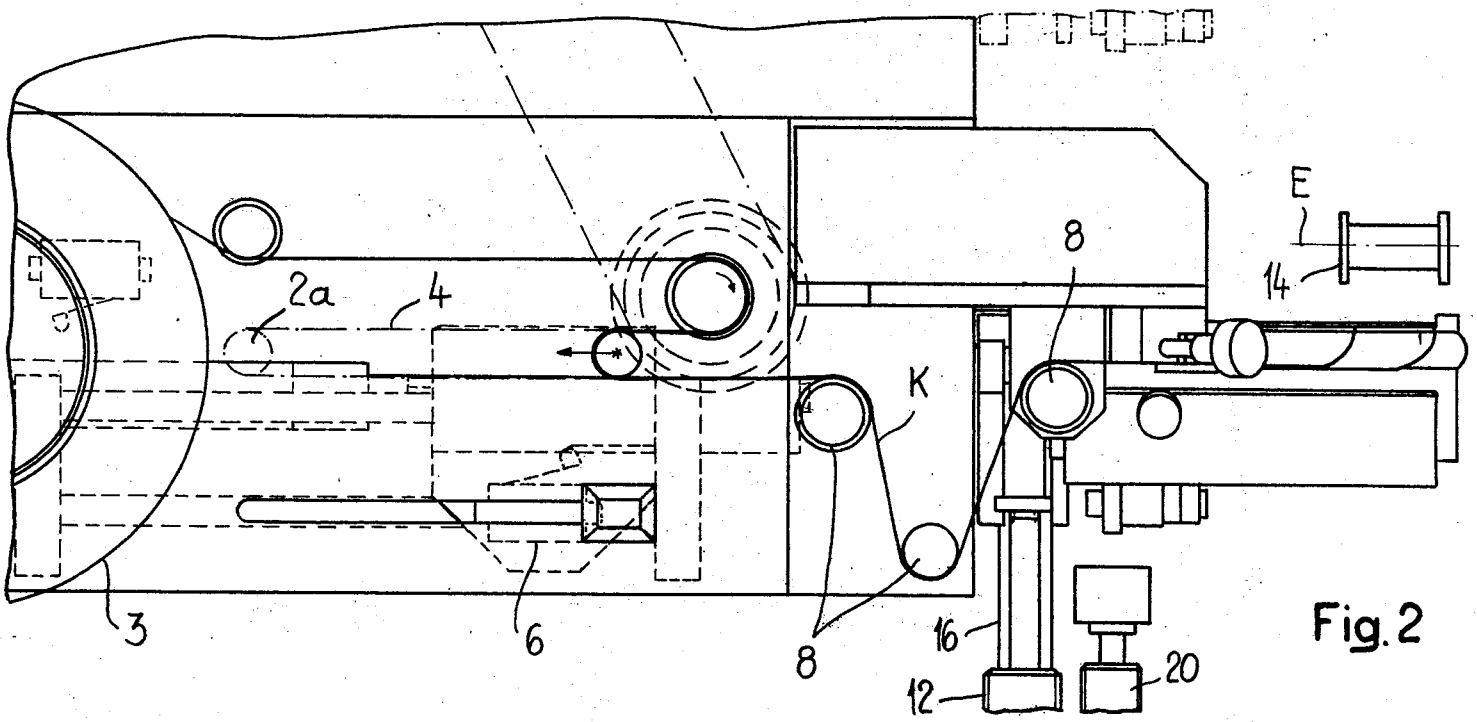
FIG. 2 is a side view of the device of FIG. 1.

The device comprises a gearbox 50 which is fixedly mounted on a machine frame relative to a rotatable turret table which is not shown. A horizontal plane E (FIG. 2) of the turret table supports coil mandrels which are not shown but are radially arranged with respect to the axis of rotation of the turret table.

On one of its sides the gearbox 50 supports a knurled feed roller 2 which is driven by a geared motor 1 via a belt 1*a*. A trunnion 3*a*, on which an adhesive tape supply reel 3 is situated, is arranged on the same side of the gearbox parallel to the axis of the feed roller 2. The feed roller 2 draws off adhesive tape K from the adhesive tape supply reel 3 and passes it round a horizontally-slidable reversing pulley 2*a* to guide roller 8. The reversing pulley 2*a* forms a reserve loop of adhesive tape between the feed roller 2 and the first of the three guide rollers 8, the loop being maintained under tension by means of a pneumatic cylinder 5 through which the reversing pulley is displaced. The geared motor 1 is switched on by means of microswitches 6 arranged in the sliding path of the reversing pulley 2*a* if the length of adhesive tape in the reserve loop is spent so that fresh adhesive tape is drawn off from the adhesive tape supply reel 3. Displacement of the reversing pulley 2*a* into the limiting position on the left-hand side of FIG. 2 stores drawn-off adhesive tape in the form of a reserve loop 4. The guide rollers 8 supply the adhesive tape K to a stationary turning surface 9 of cylindrical shape, the axis of the cylinder being horizontal but being at an angle of approximately 45° to the axes of the guide rollers 8. The position of the turning surface 9 can be altered by means of an adjusting screw 10.

The adhesive tape, which slides over the surface 9 by means of its non-adhesive back, is turned through 90° so that it then passes approximately horizontally along the end face of the gearbox 50.

Figure 1:
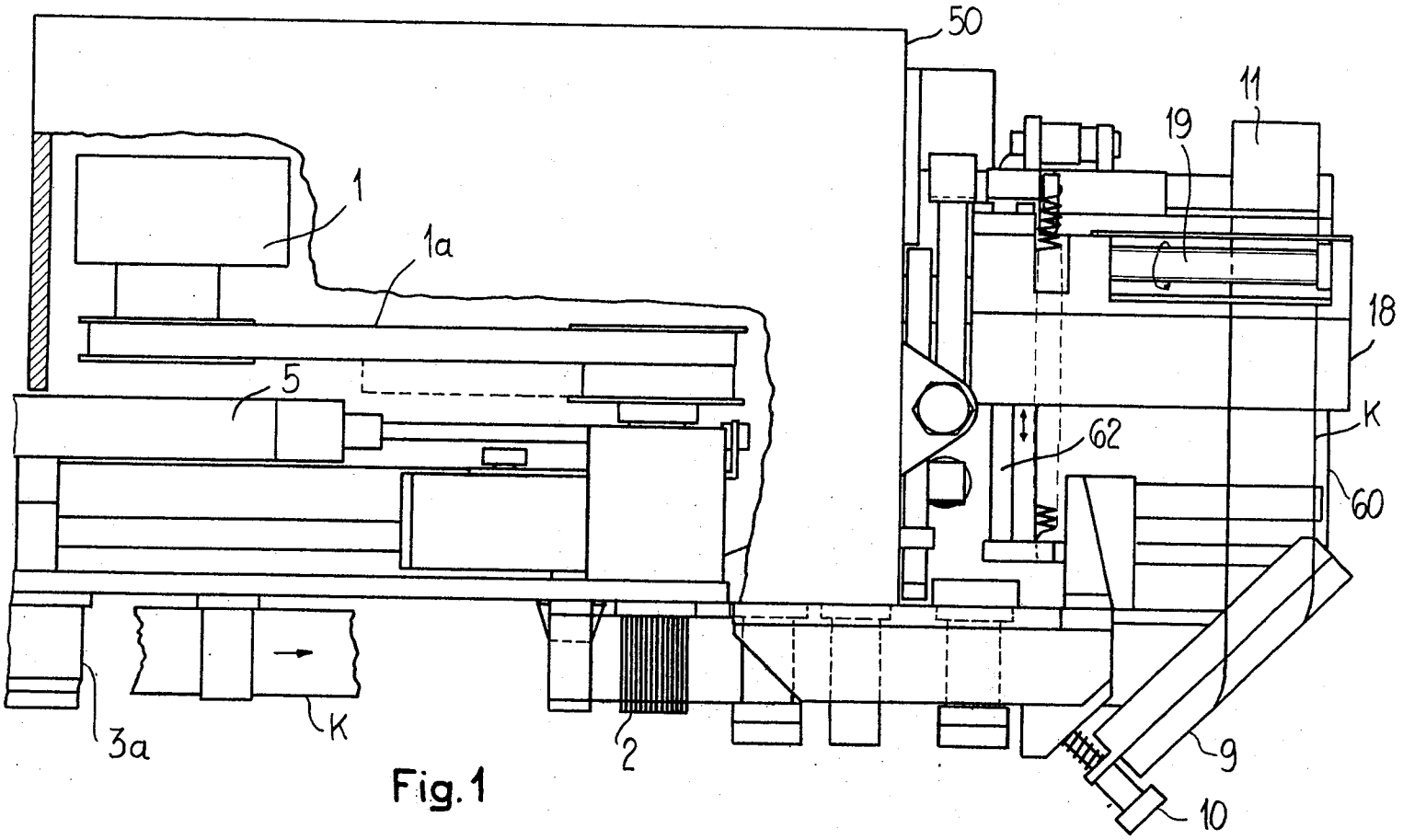
FIG. 1 is a plan view, partially sectioned, of the device.
Figure 3:
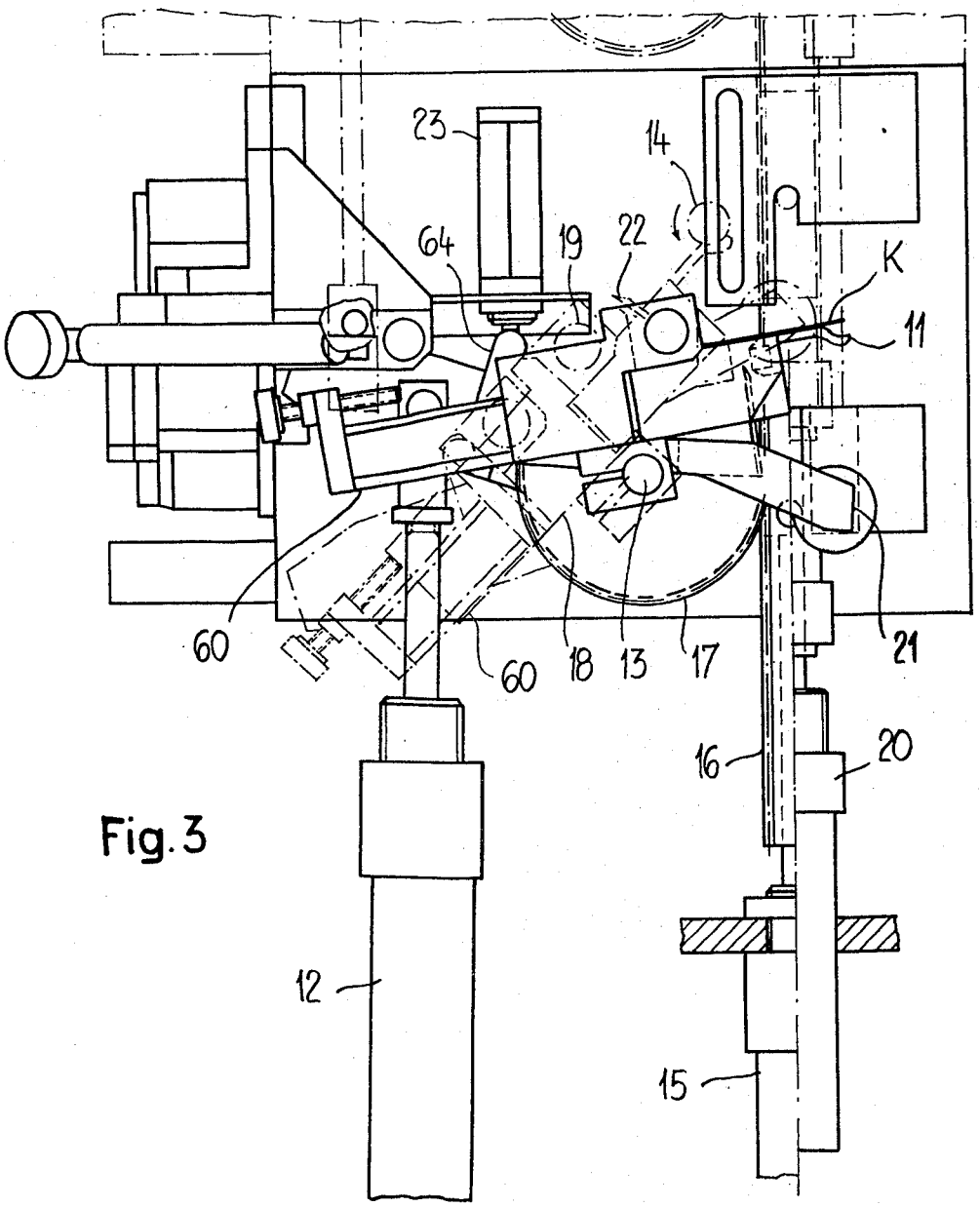
FIG. 3 is an end view of the device of FIG. 1.

A support 60 is mounted on the end face of the gearbox 50 and is pivotable about a horizontal trunnion 13 (FIG. 3). The support 60 supports a slide 18, which is slidable along a guide rod 62 (FIG. 1). FIG. 3 shows the inoperative position of the support 60 in solid lines and the right-hand limiting position of the slide 18 in solid lines, this limiting position being adjacent to a pressure foot 11 which is rigidly mounted on the support 60. The slide 18 supports a roller 19 which is arranged parallel to the pivoting trunnion 13 and under which the adhesive tape K extends to the pressure foot 11. If a wire coil is in a position in alignment with the device, i.e. so that the axis of the device extends parallel to the pivoting trunnion 13, the support 60 will be pivoted from the inoperative position into the operative position shown in dash dot lines. The adhesive side of the adhesive tape K will then bear upon the surface of the wire coil (FIG. 3), the tape being pressed by the pressure foot 11 against the said surface. If the coil mandrel supporting the coil 14 is then rotated by driving means (not shown), adhesive tape will be pulled from the reserve loop 4 via the guide rollers 8, the turning surface 9 and the roller 19 so that a complete turn of adhesive tape is formed on the wire coil 14. The pneumatic cylinder 15 is actuated either prior to or during the formation of the complete turn of adhesive tape on the coil 14, so as to move the slide 18 into the left-hand limiting position away from the pressure foot 11 by means of a rack 16, a gearwheel 17 and a pinion (not shown) which meshes with corresponding teeth on the slide 18. This causes the roller 19, which is freely rotatable in an anticlockwise direction, to roll on the adhesive tape. When the coil mandrel has traversed through a specific angle of rotation a thrust cylinder 20 is actuated and pivots a knife 22, pivotable about the trunnion 13, through an arm 21 so that the adhesive tape is cut at a place situated between the coil 14 and the roller 19. The support 60 is again pivoted into the inoperative position by the cylinder 12 once the cut end of the adhesive tape is completely wound on the coil 14. On reaching this inoperative position a valve 23 is actuated by means of a trip 64 mounted on the support 60, the valve 23 initiating a stroke of the cylinder 15 which in turn causes the slide 18 to be moved into its right-hand limiting position adjacent to the pressure foot 11. The roller 19 contains locking means which prevent clockwise rotation of the roller 19 which would be caused by the tensile stress in the adhesive tape K as a result of displacement of the slide 18 to the right-hand limiting position. Accordingly, the sliding motion of the slide 18 causes adhesive tape to be fed into a standby position over the pressure foot 11. The device is then ready to apply adhesive tape to a fresh coil as soon as this has reached the appropriate position.

The illustrated turning of the adhesive tape through 90° offers the important advantage of utilizing the depth of the space (approximately radially in front of the coil mandrels) for accommodating the supply reel and the adhesive tape feed means with reserve loop. It is therefore possible to arrange the operating stations on the circumference of the turret table at relatively short distances (pitch) from each other. The space above or below the support 60 remains free so that several devices can be arranged one above the other. The thrust cylinders 12, 15 and 20 in this case can be constructed for the common operation of the supports, slides or knives of a plurality of devices. Accordingly, the turret table can be constructed in several decks so that the number of winding mandrels of a machine can be increased without substantially increasing the area occupied by the machine.

I claim:

1. Device for applying adhesive tape to a wire coil comprising a support movable between an inoperative and an operative position; a pressure member on the support for urging adhesive tape against a wire coil in the operative position of the support; a slide slidable on the support between two limiting positions in a direction transverse to the direction of movement of the support; means on the slide for pulling adhesive tape towards the pressure member when said slide moves into one of said limiting positions; and cutting means movable on a path which extend transversely of the direction of movement of the slide between one of said limiting positions and said pressure member.

2. Device according to claim 1, wherein said support is pivotably movable.

3. Device according to claim 2, wherein the adhesive-tape pulling means comprises a roller rotatable in one direction only about an axis parallel to the axis of pivoting of the support.

4. Device according to claim 2, wherein said cutting means is movable on a circular path about the axis of pivoting of the support.

5. Device according to claim 2, comprising means for supporting a reel of adhesive tape, a feed roller for drawing adhesive tape off the adhesive-tape reel and being arranged substantially at right angles to the pivoting axis of said support, and means for turning the tape through substantially a right angle towards the support.

6. Device according to claim 5, wherein said tape-turning means comprise a stationary cylindrical surface for turning the tape.

7. Device as claimed in claim 6, wherein the longitudinal axis of said stationary cylindrical surface is specially adjustable.

8. Device according to claim 5, comprising means for forming a reserve loop of adhesive tape between said feed roller and said tape-turning means.

* * * * *